US009905093B1

(12) United States Patent
Burgess

(10) Patent No.: US 9,905,093 B1
(45) Date of Patent: Feb. 27, 2018

(54) AUXILIARY ALARM FOR EXISTING ALARM SYSTEM

(71) Applicant: Samuel Burgess, West Jordan, UT (US)

(72) Inventor: Samuel Burgess, West Jordan, UT (US)

( * ) Notice: Subject to any disclaimer, the term of this patent is extended or adjusted under 35 U.S.C. 154(b) by 0 days.

(21) Appl. No.: 15/225,905

(22) Filed: Aug. 2, 2016

(51) Int. Cl.
*G08B 7/06* (2006.01)

(52) U.S. Cl.
CPC ..... *G08B 7/06* (2013.01)

(58) Field of Classification Search
CPC ..... G08B 7/06
USPC ..... 340/501
See application file for complete search history.

(56) References Cited

U.S. PATENT DOCUMENTS

| | | | | |
|---|---|---|---|---|
| 4,612,535 | A | 9/1986 | Sequin | |
| 5,177,461 | A | 1/1993 | Budzyna | |
| 5,570,077 | A | 10/1996 | Swieboda | |
| 6,222,455 | B1 | 4/2001 | Kaiser | |
| 6,249,221 | B1 | 6/2001 | Reed | |
| 6,249,225 | B1 * | 6/2001 | Wang | G08B 25/008 340/330 |
| D608,671 | S | 1/2010 | Treharne | |
| 8,622,147 | B1 | 1/2014 | Williams | |
| 8,786,404 | B1 * | 7/2014 | Tillman | G08B 5/22 340/501 |
| 2014/0375464 | A1 * | 12/2014 | Caragata | G01N 1/24 340/632 |
| 2015/0077248 | A1 * | 3/2015 | Eck | G08B 17/10 340/539.26 |

FOREIGN PATENT DOCUMENTS

| | | | |
|---|---|---|---|
| EP | 0011205 | A1 | 12/1982 |

* cited by examiner

*Primary Examiner* — Qutbuddin Ghulamali
(74) *Attorney, Agent, or Firm* — Kyle A. Fletcher, Esq.

(57) ABSTRACT

The auxiliary alarm for existing alarm system is adapted for use with an installed security system. The auxiliary alarm for existing alarm system monitors each individual alarm condition monitored by the installed security system. The auxiliary alarm for existing alarm system is organized into a plurality of alarm channels. Each alarm channel contained within plurality of alarm channels corresponds to an individual alarm condition monitored by the installed security system. When the installed security system generates an alarm condition, the auxiliary alarm for existing alarm system turns on an alarm channel selected from a plurality of alarm channels. The selected alarm channel then generates a visual alarm and an audible alarm that clearly identifies the individual alarm condition that triggered the installed security system to generate the general alarm. The auxiliary alarm for existing alarm system comprises a housing and a control system.

10 Claims, 4 Drawing Sheets

AUXILIARY ALARM FOR EXISTING ALARM SYSTEM

CROSS REFERENCES TO RELATED APPLICATIONS

Not Applicable

STATEMENT REGARDING FEDERALLY SPONSORED RESEARCH Not Applicable

REFERENCE TO APPENDIX

Not Applicable

BACKGROUND OF THE INVENTION

Field of the Invention

The present invention relates to the field of signaling systems, calling systems and alarm systems, more specifically, a visible and audible signaling system for announcing alarm conditions.

The use of modern alarm and security systems protects both lives and the resources of the organizations and individuals that use them. Modern alarm and security systems monitor a large variety of dangers including, but not limited to, the accumulation of carbon monoxide, smoke and fire detection, and the physical security of perimeters and checkpoints.

Unfortunately, as the breadth of potential dangers a modern alarm and security system monitors is expanded, they have become confusing. Specifically, the alarms generated by many of these existing modern alarm and security systems generally comprise an audible siren that merely indicates an alarm has occurred without providing additional information regarding the nature of the alarmed hazard or emergency. In many cases, a person specially trained in the operation of the alarm system has to physically go to a panel to determine the source of the alarm.

Clearly a more broadly and easily interpretable system of categorizing and organizing alarms would be of great benefit in responding to emergency situations.

SUMMARY OF INVENTION

The auxiliary alarm for existing alarm system is adapted for use with an installed security system. The auxiliary alarm for existing alarm system monitors each individual alarm condition monitored by the installed security system. The auxiliary alarm for existing alarm system is organized into a plurality of alarm channels. Each alarm channel contained within plurality of alarm channels corresponds to an individual alarm condition monitored by the installed security system. When the installed security system generates an alarm condition, the auxiliary alarm for existing alarm system turns on an alarm channel selected from a plurality of alarm channels. The selected alarm channel then generates a visual alarm and an audible alarm that clearly identifies the individual alarm condition that triggered the installed security system to generate the general alarm.

These together with additional objects, features and advantages of the auxiliary alarm for existing alarm system will be readily apparent to those of ordinary skill in the art upon reading the following detailed description of the presently preferred, but nonetheless illustrative, embodiments when taken in conjunction with the accompanying drawings.

In this respect, before explaining the current embodiments of the auxiliary alarm for existing alarm system in detail, it is to be understood that the auxiliary alarm for existing alarm system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the auxiliary alarm for existing alarm system.

It is therefore important that the claims be regarded as including such equivalent construction insofar as they do not depart from the spirit and scope of the auxiliary alarm for existing alarm system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
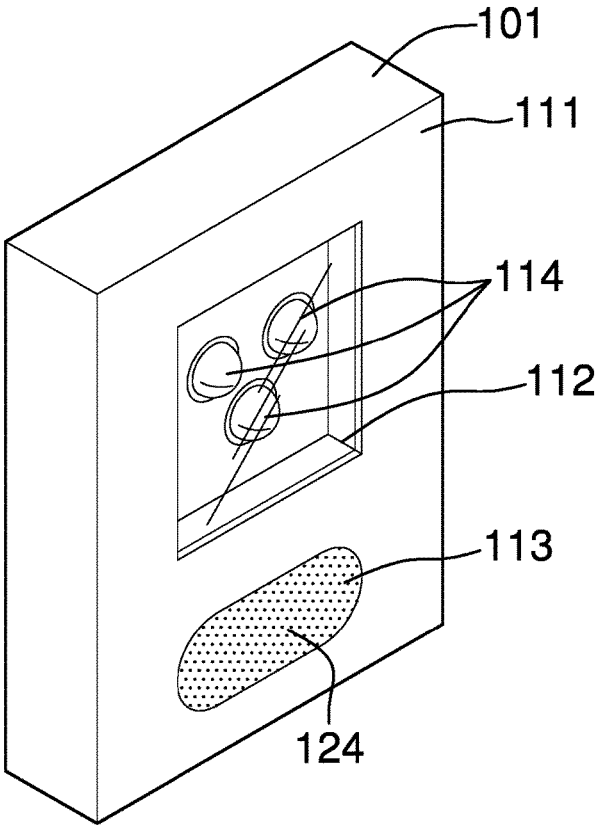
FIG. 1 is a perspective view of an embodiment of the disclosure.
Figure 2:
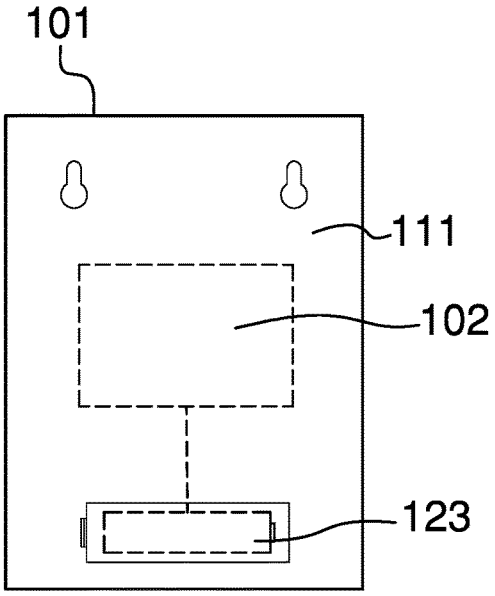
FIG. 2 is a rear view of an embodiment of the disclosure.
Figure 3:
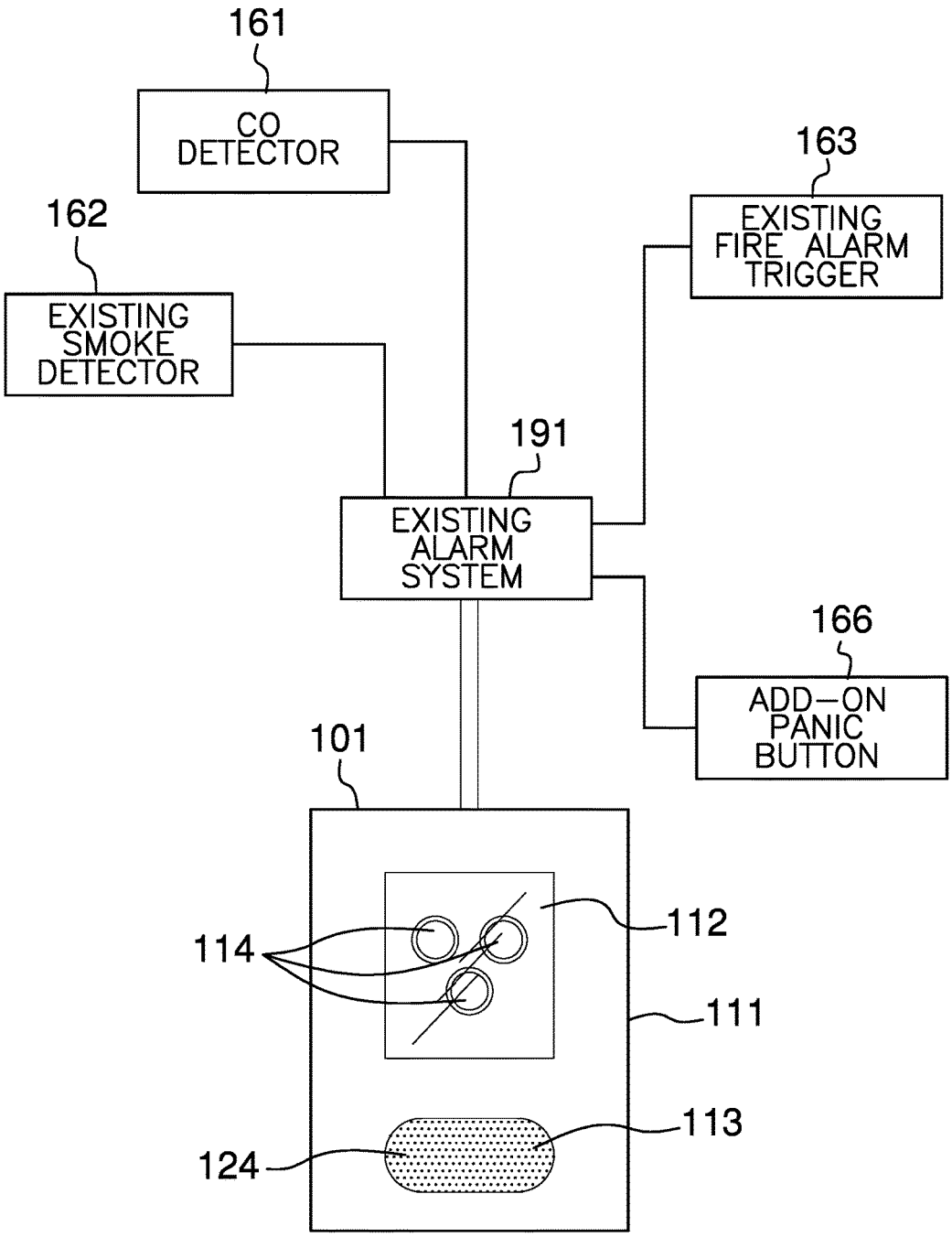
FIG. 3 is a block diagram of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 5.

The auxiliary alarm for existing alarm system 100 (hereinafter invention) comprises a housing 101 and a control system 102. The control system 102 is contained within the housing 101. The invention 100 is adapted for use with an installed security system 191. The installed security system 191 monitors a plurality of alarms 160. The invention 100 monitors the plurality of alarms 160 monitored by the installed security system 191. The invention 100 is organized into a plurality of alarm channels 130. Each alarm channel contained within plurality of alarm channels 130 corresponds to an individual alarm condition selected from the plurality of alarms 160 that are monitored by the installed security system 191. When the installed security system 191 generates an alarm condition selected from the plurality of alarms 160, the invention 100 turns on the corresponding alarm channel selected from a plurality of alarm channels 130. The selected corresponding alarm channel generates a visual alarm and an audible alarm that clearly identifies the individual alarm condition selected from the plurality of alarms 160 that triggered the installed security system 191 to generate a general alarm.

The control system 102 comprises a logic module 121, a memory module 122, a speaker 124, and the plurality of alarm channels 130. The logic module 121 is a readily and commercially available programmable electronic device that is used to control and operate the control system 102. Each alarm channel selected from the plurality of alarm channels 130 further comprises an audio alarm file selected from a plurality of audio alarm files 140 and a visual alarm selected from a plurality of visual alarms 150. There is a one to one correspondence between any alarm channel selected from the plurality of alarm channels 130 and an audio alarm file selected from the plurality of audio alarm files 140. This insures that any audio alarm generated by the invention 100 is unique to the alarm condition selected from the plurality of alarms 160 that corresponds to the selected alarm channel. There is a further one to one correspondence between any alarm channel selected from the plurality of alarm channels 130 and a video alarm selected from the plurality of visual alarms 150. This insures that any video alarm generated by the invention 100 is unique to the alarm condition selected from the plurality of alarms 160 that corresponds to the selected alarm channel. Each of the plurality of audio files 140 is an individual audio file that is stored in the memory module 122. The memory module 122 is a readily and commercially available electronic device that is used to store information in a digitally encoded data.

Each of the plurality of audio files 140 contains a spoken message verbally stating the specific individual alarm condition selected from the plurality of alarms 160 that triggered the installed security system 191 to generate the general alarm. When an alarm channel selected from the plurality of alarm channels 130 is activated, the logic module 121 queries the memory module 122 to download the specific audio alarm file corresponding to the selected alarm channel and then converts the selected audio file into an electronic signal that is sent to the speaker 124 for audible announcement. The speaker 124 is a readily and commercially available speaker 124.

Each visual alarm selected from the plurality of visual alarms 150 is a light 125 that is dedicated to the selected visual alarm. When an alarm channel selected from the plurality of alarm channels 130 is activated, the logic module 121 powers a circuit that illuminates the light 125. It is preferred that each light 125 be a unique color such that the underlying individual alarm condition selected from the plurality of alarms 160 can be more readily identified. As shown most clearly in FIG. 4, in a first potential embodiment of the disclosure, each visual alarm selected from the plurality of visual alarms 150 comprises an LED for the light 125 and an associated limit resistor 126.

The housing 101 comprises a chamber 111, a window 112, a speaker aperture 113 and a plurality of light apertures 114. The chamber 111 is a rigid hollow box that contains the control system 102. The speaker aperture 113 is a hole that is formed in the chamber 111 within which the speaker 124 is mounted such that audible sounds produced by the speaker 124 are audible from the exterior of the housing 101. Each of the plurality of light apertures 114 is an individual hole formed in the chamber 111. Each of the plurality of light apertures 114 receives a light 125 associated with a visual alarm selected from the plurality of visual alarms 150 in such a manner that the light 125 associated with a selected visual alarm is visible from the exterior of the housing 101.

The above paragraph can be made clearer using the first potential embodiment of the disclosure as an example. This example is exemplary in nature and should not necessarily be construed as preferred or advantageous over other implementations. This example is provided for the purposes of simplicity and for clarity of exposition of the disclosure and is not intended to limit the scope of the appended claims but is instead provided to enable persons skilled in the art to practice the disclosure. Specifically, it is noted that the first potential embodiment of the disclosure will make assumptions regarding the individual alarm condition contained within the plurality of alarms 160 that are monitored by the installed security system 191 that can be readily modified without undue experimentation.

This specification now moves to a detailed description of a first potential embodiment of the disclosure.

In the first potential embodiment of the disclosure, the invention 100 is designed to monitor a plurality of alarms 160 from the installed security system 191. The plurality of alarms 160 comprises a first alarm 161, a second alarm 162, a third alarm 163, a fourth alarm 164, a fifth alarm 165, a sixth alarm 166, a seventh alarm 167, and an eighth alarm 168. The first alarm 161 is a signal received from the installed security system 191 indicating that carbon monoxide has been detected. The second alarm 162 is a signal received from the installed security system 191 indicating that smoke has been detected. The third alarm 163 is a signal received from the installed security system 191 indicating that one of the manual fire alarms has been activated. The fourth alarm 164 is a signal received from the installed security system 191 indicating that the sprinkler system has been activated. The fifth alarm 165 is a signal received from the installed security system 191 indicating that a security breach has been detected. Security breaches can occur along the perimeter of the area secured by the installed security system 191 or internal to the area secured by the installed security system 191. The sixth alarm 166 is a signal received from the installed security system 191 indicating that a panic button has been activated.

A panic button of the installed security system 191 comprises one or more switches monitored by the installed security system 191 that is designed to be manually activated for the purpose of tripping the alarm of the installed security system 191 in order to generate an immediate emergency response to an otherwise unmonitored emergency situation. The seventh alarm 167 is a signal received from the installed security system 191 indicating that a custom alarm 167 has been activated. The custom alarm 167 is a sensor integrated into the installed security system 191 that monitors a potential security weakness specifically identified within the area secured by the installed security system 191 that is not otherwise monitored within this described structure. The eighth alarm 168 is a signal received from the installed security system 191 indicating that a duress alarm 168 has been activated. A duress alarm 168 is a predetermined security code that can be used to deactivate the installed security system 191. The use of the duress alarm 168 indicates that the installed security system 191 is being deactivated under duress. The assumption underlying the use of the duress code is that the enterer is under some form of personal physical threat and that immediate but discrete emergency assistance. In these instances, the installed security system 191 will generally appear to shut down and send silent alarms directly to the appropriate authorities The plurality of alarm channels 130 further comprises a first alarm channel 131, a second alarm channel 132, a third alarm channel 133, a fourth alarm channel 134, a fifth alarm channel 135, a sixth alarm channel 136, and a seventh alarm channel 137. The first alarm channel 131 corresponds to the first alarm 161. The second alarm channel 132 corresponds to the second alarm 162. The third alarm channel 133 corresponds to the third alarm 163. The fourth alarm channel 134 corresponds to the fourth alarm 164. The fifth alarm channel 135 corresponds to the fifth alarm 165. The sixth alarm channel 136 corresponds to the sixth alarm 166. The seventh alarm channel 137 corresponds to the seventh alarm 167. As described elsewhere in this disclosure, the eighth alarm 168 is handled logically and does not require a separate alarm channel.

The plurality of audio alarm files 140 further comprises a first audio alarm file 141, a second audio alarm file 142, a third audio alarm file 143, a fourth audio alarm file 144, a fifth audio alarm file 145, a sixth audio alarm file 146, and a seventh audio alarm file 147. The plurality of visual alarms 150 further comprises a first visual alarm 151, a second visual alarm 152, a third visual alarm 153, a fourth visual alarm 154, a fifth visual alarm 155, a sixth visual alarm 156, and a seventh visual alarm 157. The first alarm channel 131 comprises the first audio alarm file 141 and the first video alarm 151. The second alarm channel 132 comprises the second audio alarm file 142 and the second video alarm 152. The third alarm channel 133 comprises the third audio alarm file 143 and the third video alarm 153. The fourth alarm channel 134 comprises the fourth audio alarm file 144 and the fourth video alarm 154. The fifth alarm channel 135 comprises the fifth audio alarm file 145 and the fifth video alarm 155. The sixth alarm channel 136 comprises the sixth audio alarm file 146 and the sixth video alarm 156. The seventh alarm channel 137 comprises the seventh audio alarm file 147 and the seventh video alarm 157.

The operation of the first potential embodiment of the disclosure is now described in this paragraph. The logic module 121 makes a first decision 201 to determine whether the first alarm 161 is activated. If the first alarm 161 is activated, the logic module 121 takes a first action 211 of turning on the first alarm channel 131. If the first alarm 161 is not activated, the logic module 121 takes a second action 212 of turning off the first alarm channel 131. The logic module 121 next makes a second decision 202 to determine whether the second alarm 162 is activated. If the second alarm 162 is activated, the logic module 121 takes a third action 213 of turning on the second alarm channel 132. If the second alarm 162 is not activated, the logic module 121 takes a fourth action 214 of turning off the second alarm channel 132. The logic module 121 next makes a third decision 203 to determine whether the third alarm 163 is activated. If the third alarm 163 is activated, the logic module 121 takes a fifth action 215 of turning on the third alarm channel 133. If the third alarm 163 is not activated, the logic module 121 takes a sixth action 216 of turning off the third alarm channel 133.

The logic module 121 next makes a fourth decision 204 to determine whether the fourth alarm 164 is activated. If the fourth alarm 164 is activated, the logic module 121 takes a seventh action 217 of turning on the fourth alarm channel 134. If the fourth alarm 164 is not activated, the logic module 121 takes an eighth action 218 of turning off the fourth alarm channel 134. The logic module 121 next makes a fifth decision 205 to determine whether the fifth alarm 165 is activated. If the fifth alarm 165 is activated, the logic module 121 takes a ninth action 219 of turning on the fifth alarm channel 135. If the fifth alarm 165 is not activated, the logic module 121 takes a tenth action 220 of turning off the fifth alarm channel 135. The logic module 121 next makes a sixth decision 206 to determine whether the sixth alarm 166 is activated. If the sixth alarm 166 is activated, the logic module 121 takes an eleventh action 221 of turning on the sixth alarm channel 136. If the sixth alarm 166 is not activated, the logic module 121 takes a twelfth action 222 of turning off the sixth alarm channel 136.

The logic module 121 next makes a seventh decision 207 to determine whether the seventh alarm 167 is activated. If the seventh alarm 167 is activated, the logic module 121 takes a thirteenth action 223 of turning on the seventh alarm channel 137. If the seventh alarm 167 is not activated, the logic module 121 takes a fourteenth action 224 of turning off the seventh alarm channel 137. The logic module 121 next makes an eighth decision 208 to determine whether the eighth alarm 168 is activated. If the eighth alarm 168 is activated, the logic module 121 takes a fifteenth action 225 of deactivating the plurality of alarm channels 130. By deactivating the plurality of alarm channels 130 is that the logic module 121 will not turn on any alarm channel selected from the of the plurality of alarm channels 130 should such an alarm be received from the installed security system 191 while the eighth alarm 168 remains activated eighth alarm 168. If the eighth alarm 168 is not activated, the logic module 121 takes a sixteenth action 226 of activating the plurality of alarm channels 130. By activating the plurality of alarm channels 130, the logic module 121 will respond to any alarms received from the installed security system 191 as described elsewhere in this disclosure.

Figure 4:
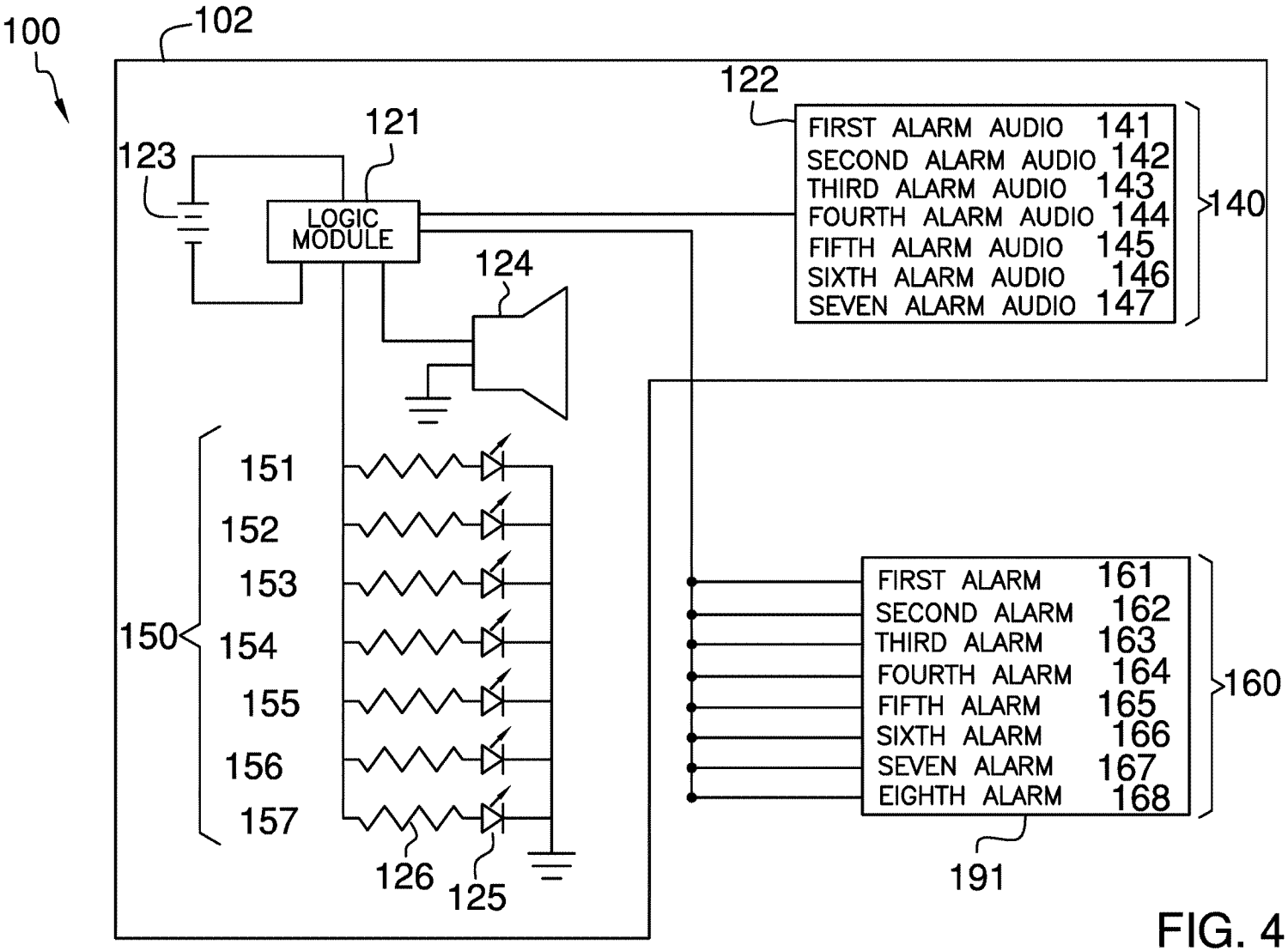
FIG. 4 is a detailed block diagram of an embodiment of the disclosure.
Figure 5:
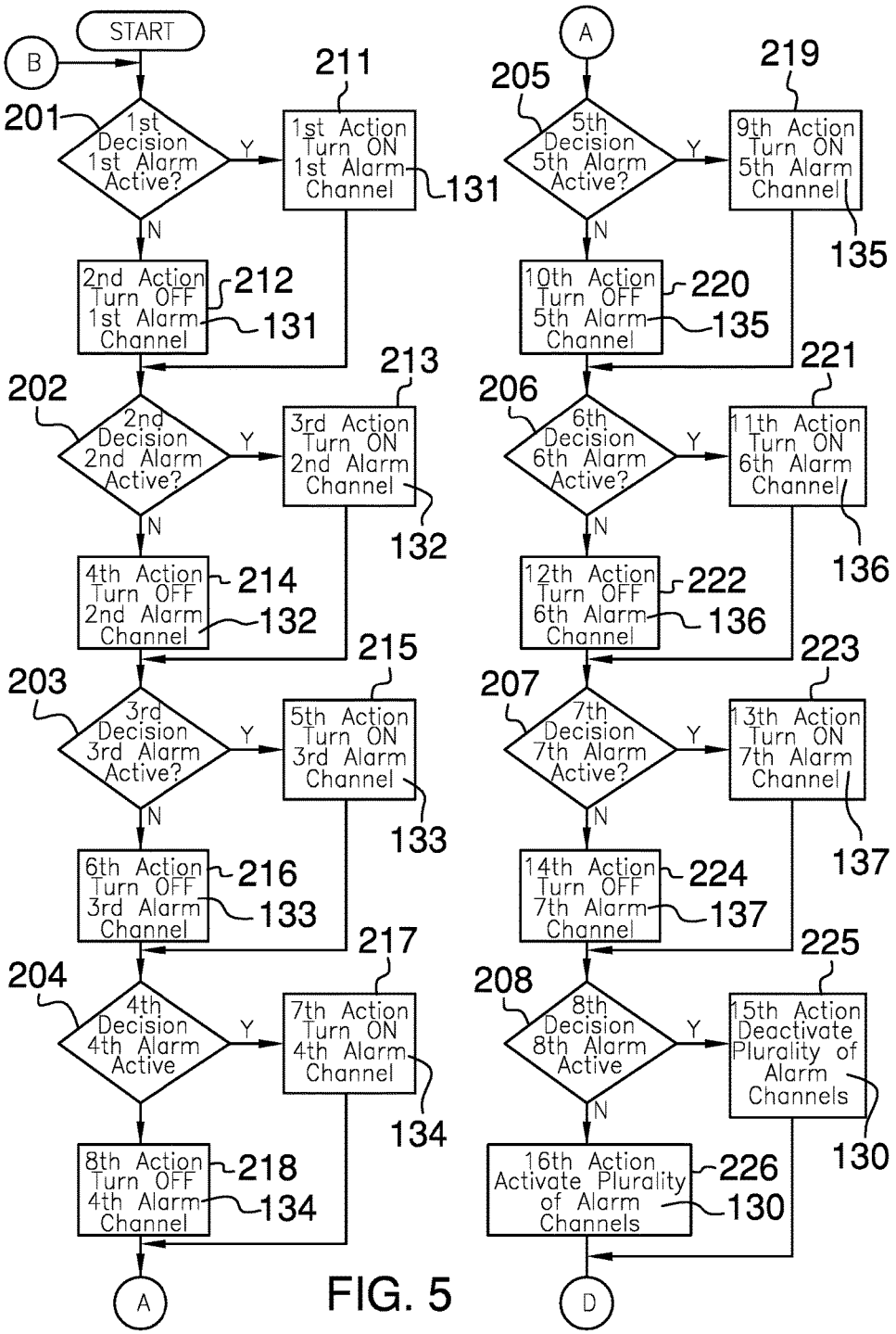
FIG. 5 is a flowchart of an embodiment of the disclosure.

As shown most clearly in FIG. 4, the control system 102 is powered with a readily and commercially available battery 123. As a shown most clearly in FIG. 1, the plurality of visual alarms 150 are protected by a window 112. The window 112 is a transparent plate placed through which each of the plurality of visual alarms 150 will illuminate.

The following definitions were used in this disclosure:

Audio File: As used in this disclosure, an audio file is a digital representation of a sound that is used to store a recording of the sound. Separate hardware is used to convert the digital representation of the sound into an audible sound.

Audio Source: As used in this disclosure, an audio source is a device that generates electrical signals that can be converted in to audible sounds by a speaker.

Battery: As used in this disclosure, a battery is a container consisting of one or more cells, in which chemical energy is converted into electricity and used as a source of power.

Correspond: As used in this disclosure, the term correspond means that a first object is in some manner linked to a second object in a one to one fashion.

Diode: As used in this disclosure, a diode is a two terminal semiconductor device that allows current flow in only one direction. The two terminals are called the anode and the cathode.

LED: As used in this disclosure, an LED is an acronym for a light emitting diode. A light emitting diode is a diode that is also a light source.

Light: As used in this disclosure, a light is an electrical device that generates visible light to illuminate objects so they can be seen.

Logic Module: As used in this disclosure, a logic module is an electrical device that is programmable and that accepts digital and analog inputs, processes the digital and analog inputs according to previously stored instruction and to provide the results of these instructions as digital or analog outputs.

Sensor: As used in this disclosure, a sensor is a device that receives and responds in a predetermined way to a signal or stimulus. As further used in this disclosure, a threshold sensor is a sensor that generates a signal that indicates whether the signal or stimulus is above or below a given threshold for the signal or stimulus.

Speaker: As used in this disclosure, a speaker is a transducer that converts an electrical signal into an audible sound.

Transducer: As used in this disclosure, a transducer is a device that converts a physical quantity, such as pressure or brightness into an electrical signal or a device that converts an electrical signal into a physical quantity.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A signaling system comprising:

a housing and a control system;

wherein the control system is contained within the housing;

wherein the signaling system is adapted for use with an installed security system;

wherein the installed security system generates a general alarm;

wherein the installed security system generates a plurality of alarms;

wherein the signaling system monitors the plurality of alarms generated by the installed security system;

wherein the signaling system is organized into a plurality of alarm channels;

wherein each alarm channel contained within the plurality of alarm channels corresponds to an individual alarm condition selected from the plurality of alarms that are generated by the installed security system;

wherein when the installed security system generates an alarm condition selected from the plurality of alarms, the signaling system activates the corresponding alarm channel selected from a plurality of alarm channels;

wherein when activated the selected corresponding alarm channel generates a visual alarm and an audible alarm that identifies the individual alarm condition selected from the plurality of alarms that triggered the installed security system to generate the general alarm;

wherein the control system comprises a logic module, a memory module, a speaker, and the plurality of alarm channels;

wherein the memory module, the speaker, and the plurality of alarm channels are connected to the logic module;

wherein the logic module is an electronic device that controls and operates the control system;

wherein each alarm channel selected from the plurality of alarm channels further comprises an audio alarm file selected from a plurality of audio alarm files;

wherein each alarm channel selected from the plurality of alarm channels further comprises a visual alarm selected from a plurality of visual alarms;

wherein there is a one to one correspondence between any alarm channel selected from the plurality of alarm channels and an audio alarm file selected from the plurality of audio alarm files;

wherein there is a further one to one correspondence between any alarm channel selected from the plurality of alarm channels and a video alarm selected from the plurality of visual alarms;

wherein each of the plurality of audio files is an individual audio file that is stored in the memory module;

wherein the memory module is a readily and commercially available electronic device that is used to store information in a digitally encoded data;

wherein each of the plurality of audio files contains a spoken message verbally stating the specific individual alarm condition selected from the plurality of alarms that triggered the installed security system to generate the general alarm;

wherein when an alarm channel selected from the plurality of alarm channels is activated, the logic module queries the memory module to download the specific audio alarm file corresponding to the selected alarm channel and then converts the selected audio file into an electronic signal that is sent to the speaker for audible announcement;

wherein each visual alarm selected from the plurality of visual alarms is a light that is dedicated to the selected visual alarm;

wherein when an alarm channel selected from the plurality of alarm channels is activated, the logic module powers an electric circuit that illuminates the light;

wherein the housing comprises a chamber, a window, a speaker aperture and a plurality of light apertures;

wherein the chamber is a rigid hollow box that contains the control system;

wherein the speaker aperture is a hole that is formed in the chamber within which the speaker is mounted such that audible sounds produced by the speaker are audible from the exterior of the housing;

wherein each of the plurality of light apertures is an individual hole formed in the chamber;

wherein each of the plurality of light apertures receives a light associated with a visual alarm selected from the plurality of visual alarms in such a manner such that the light associated with a selected visual alarm is visible from the exterior of the housing;

wherein the plurality of alarms comprises a first alarm, a second alarm, a third alarm, and a fourth alarm;

wherein the plurality of alarm channels further comprises a first alarm channel, a second alarm channel, a third alarm channel, and a fourth alarm channel;

wherein the first alarm channel corresponds to the first alarm;

wherein the second alarm channel corresponds to the second alarm;

wherein the third alarm channel corresponds to the third alarm;

wherein the fourth alarm channel corresponds to the fourth alarm;

wherein the plurality of audio alarm files further comprises a first audio alarm file, a second audio alarm file, a third audio alarm file, and a fourth audio alarm file;

wherein the plurality of visual alarms further comprises a first visual alarm, a second visual alarm, a third visual alarm, and a fourth visual alarm;

wherein the first alarm channel comprises the first audio alarm file and the first video alarm;

wherein the second alarm channel comprises the second audio alarm file and the second video alarm;

wherein the third alarm channel comprises the third audio alarm file and the third video alarm;

wherein the fourth alarm channel comprises the fourth audio alarm file and the fourth video alarm;

wherein the logic module makes a first decision to determine whether the first alarm is activated;

wherein if the first alarm is activated the logic module takes a first action of activating the first alarm channel;

wherein if the first alarm is not activated the logic module takes a second action of deactivating the first alarm channel;

wherein the logic module makes a second decision to determine whether the second alarm is activated;

wherein if the second alarm is activated the logic module takes a third action of activating the second alarm channel;

wherein if the second alarm is not activated the logic module takes a fourth action of deactivating the second alarm channel;

wherein the logic module makes a third decision to determine whether the third alarm is activated;

wherein if the third alarm is activated the logic module takes a fifth action of activating the third alarm channel;

wherein if the third alarm is not activated the logic module takes a sixth action of deactivating the third alarm channel;

wherein the logic module makes a fourth decision to determine whether the fourth alarm is activated;

wherein if the fourth alarm is activated the logic module takes a seventh action of activating the fourth alarm channel;

wherein if the fourth alarm is not activated the logic module takes an eighth action of deactivating the fourth alarm channel.

2. The signaling system according to claim 1 wherein the control system is powered with a battery.

3. The signaling system according to claim 2 wherein the plurality of visual alarms are protected by a window;

wherein the window is a transparent plate placed through which each of the plurality of visual alarms will illuminate.

4. The signaling system according to claim 3 wherein each light contained within the plurality of visual alarms is a unique color.

5. The signaling system according to claim 4 wherein the each visual alarm selected from the plurality of visual alarms comprises an LED for the light and an associated limit resistor.

6. The signaling system according to claim 1 wherein the plurality of alarms further comprises a fifth alarm, a sixth alarm, a seventh alarm, and an eighth alarm;

wherein the plurality of alarm channels further comprises a fifth alarm channel, a sixth alarm channel, and a seventh alarm channel;

wherein the fifth alarm channel corresponds to the fifth alarm;

wherein the sixth alarm channel corresponds to the sixth alarm;

wherein the seventh alarm channel corresponds to the seventh alarm;

wherein the eighth alarm does not require a separate alarm channel.

7. The signaling system according to claim 6 wherein the plurality of audio alarm files further comprises a fifth audio alarm file, a sixth audio alarm file, and a seventh audio alarm file;

wherein the plurality of visual alarms further comprises a fifth visual alarm, a sixth visual alarm, and a seventh visual alarm;

wherein the fifth alarm channel comprises the fifth audio alarm file and the fifth video alarm;

wherein the sixth alarm channel comprises the sixth audio alarm file and the sixth video alarm;

wherein the seventh alarm channel comprises the seventh audio alarm file and the seventh video alarm.

8. The signaling system according to claim 7 wherein the logic module makes a fifth decision to determine whether the fifth alarm is activated;

wherein if the fifth alarm is activated the logic module takes a ninth action of activating the fifth alarm channel;

wherein if the fifth alarm is not activated the logic module takes a tenth action of deactivating the fifth alarm channel;

wherein the logic module makes a sixth decision to determine whether the sixth alarm is activated;

wherein if the sixth alarm is activated the logic module takes an eleventh action of activating the sixth alarm channel;

wherein if the sixth alarm is not activated the logic module takes a twelfth action of deactivating the sixth alarm channel;

wherein the logic module makes a seventh decision to determine whether the seventh alarm is activated;

wherein if the seventh alarm is activated the logic module takes a thirteenth action of activating the seventh alarm channel;

wherein if the seventh alarm is not activated the logic module takes a fourteenth action of deactivating the seventh alarm channel;

wherein the logic module next makes an eighth decision to determine whether the eighth alarm is activated;

wherein if the eighth alarm is activated the logic module takes a fifteenth action of deactivating the plurality of alarm channels;

wherein by deactivating the plurality of alarm channels it is specifically meant that the logic module will not activate any alarm channel selected from the of the plurality of alarm channels should such an subsequent alarm be received from the installed security system while the eighth alarm remains activated eighth alarm;

wherein if the eighth alarm is not activated the logic module takes a sixteenth action of reactivating the plurality of alarm channels.

9. The signaling system according to claim 8 wherein each light contained within the plurality of visual alarms is a unique color.

10. The signaling system according to claim 9 wherein the each visual alarm selected from the plurality of visual alarms comprises an LED for the light and an associated limit resistor.

* * * * *